United States Patent [19]

Franz et al.

[11] Patent Number: 4,859,210

[45] Date of Patent: Aug. 22, 1989

[54] MOTOR FUEL OR LUBRICANT COMPOSITION CONTAINING POLYBUTYL OR POLYISOBUTYL DERIVATIVES

[75] Inventors: Dieter Franz, Ludwigshafen; Rudolf Kummer, Frankenthal; Helmut Mach, Heidelberg; Hans P. Rath, Gruenstadt, all of Fed. Rep. of Germany

[73] Assignee: BASF Aktiengesellschaft, Ludwigshafen, Fed. Rep. of Germany

[21] Appl. No.: 141,111

[22] Filed: Jan. 5, 1988

[51] Int. Cl.[4] ..... C10L 1/02; C10L 1/22

[52] U.S. Cl. ..... 44/53; 44/56; 44/62; 44/63; 44/77; 44/66; 44/70; 44/71; 44/72

[58] Field of Search ..... 44/53, 56, 66, 63, 70, 44/71, 72, 62, 77; 525/333.7

[56] References Cited

U.S. PATENT DOCUMENTS

| | | | |
|---|---|---|---|
| 3,082,070 | 3/1963 | Eckert | 44/53 |
| 3,438,757 | 4/1969 | Honnen et al. | 44/58 |
| 3,455,664 | 7/1969 | Rosscup et al. | 44/56 |
| 3,794,586 | 2/1974 | Kimura et al. | 252/51.5 R |
| 3,844,958 | 10/1974 | Anderson et al. | 252/32.7 E |
| 3,846,088 | 11/1974 | Brown et al. | 44/56 |
| 3,864,098 | 2/1975 | Honnen | 44/58 |
| 3,879,307 | 4/1975 | Braid | 44/75 |
| 3,879,308 | 4/1975 | Miller | 44/70 |
| 3,884,821 | 5/1975 | Miller et al. | 252/51.5 R |
| 3,897,224 | 7/1975 | Chandler | 44/71 |
| 3,903,251 | 9/1975 | Sieg et al. | 44/56 |
| 3,912,463 | 10/1975 | Kozlowski et al. | 44/56 |
| 3,989,476 | 11/1976 | Abbott | 44/63 |
| 4,022,589 | 5/1977 | Alquist et al. | 44/71 |
| 4,048,081 | 9/1977 | Machleder | 44/75 |
| 4,152,499 | 5/1949 | Berzel et al. | 526/524 |
| 4,322,305 | 3/1982 | Lewis | 252/51.5 A |
| 4,342,849 | 8/1982 | Kennedy | 525/333.7 |
| 4,357,148 | 11/1982 | Graiff | 44/62 |
| 4,678,479 | 7/1987 | Holmes et al. | 44/57 |

FOREIGN PATENT DOCUMENTS

| | | |
|---|---|---|
| 0005873 | 12/1979 | European Pat. Off. . |
| 0061895 | 10/1982 | European Pat. Off. . |
| 2702604 | 7/1978 | Fed. Rep. of Germany . |
| 1432974 | 2/1966 | France . |
| 1083610 | 8/1966 | United Kingdom . |
| 1097696 | 1/1968 | United Kingdom . |

*Primary Examiner*—William R. Dixon, Jr.
*Assistant Examiner*—Margaret B. Medley
*Attorney, Agent, or Firm*—Keil & Weinkauf

[57] ABSTRACT

Fuel motor compositions and lubricant compositions contain small amounts of one or more polybutyl or polyisobutyl alcohols of the formula (I)

$$R—CH_2—OH \quad (I)$$

where R is a polybutyl or polyisobutyl radical derived from isobutene and up to 20% by weight of n-butene, or a corresponding (poly)alkoxylate or a corresponding carboxylate of the polybutyl or polyisobutyl alcohol.

These additives reduce deposition at the valves of piston engines.

9 Claims, No Drawings

MOTOR FUEL OR LUBRICANT COMPOSITION CONTAINING POLYBUTYL OR POLYISOBUTYL DERIVATIVES

The invention relates to a motor fuel composition or lubricant composition and the use of polybutyl or polyisobutyl derivatives in such compositions.

Polyisobutene derivatives have frequently been described in the literature and are used worldwide on a large scale as lubricant and motor fuel additives. The intermediates for the preparation of such additives are polybutenyl chloride, polybutenylsuccinic anhydride and polybutylphenols. They are used virtually exclusively for the preparation of detergents.

In the lubricating oil sector, these are generally referred to as ashless dispersants, and in the case of the polybutylphenols occasionally also as Mannich dispersants. The purpose of these dispersants is to keep in suspension oil-insoluble combustion residues, which in the case of diesel engines can account for up to 10% by weight of the lubricating oil (for example soot, coke, lead compounds and inorganic salts) and the caking of which to give solid particles of from 0.6 to 1.5 μm is promoted by the formation of resin-like and asphalt-like oxidation products in the lubricating oil, and thus to prevent deposits on metal surfaces, thickening of the oil and sludge deposits in the engine and to avoid corrosive wear by neutralizing acidic combustion products.

In the motor fuel sector, the secondary products are generally referred to as carburetor or valve detergents. Their task is to free the entire intake system from deposits, to prevent further deposits and to protect the system from corrosion. The deposits generally result from unstable motor fuel, such as nonhydrogenated or partially hydrogenated crack gasolines or pyrolysis gasolines, or from impurities from pipes, storage tanks and transport containers.

The preparation of ashless dispersants from the abovementioned intermediates is described in, for example, EP-A-72645 or DE-A-1 922 896, and some of the fuel additives are prepared similarly in the case of polyisobutylsuccinic anhydride derivatives, or, for example, according to GB-A-1 096 320 when polyisobutenyl chloride is used as a starting material.

Since detergents are relatively expensive to produce, there has been no lack of attempts to reduce the costs, especially in the case of motor fuel additives. This is achieved by mixing such detergents with high boiling mineral oils, brightstock and low molecular weight polymers, as described in EP-A-62940. However, these known carriers frequently have only limited compatibility and, because of their viscosity too, present the additive manufacturers with formulation problems.

It is an object of the present invention to provide fuel or lubricant compositions which contain carriers which are inexpensive to prepare, have greater stability and moreover are virtually halogen-free, i.e. free from chlorine and bromine. In addition, these carriers should, if required, also have a detergent action.

We have found that this object is achieved by a motor fuel composition or lubricant composition, each of which contains small amounts of one or more polybutyl or polyisobutyl alcohols of the general formula (I)

$$R—CH_2—OH \qquad (I)$$

where R is a polybutyl or polyisobutyl radical derived from isobutene and up to 20% by weight of n-butene and having a molecular weight $\overline{M}_N$ of from 324 to 3,000, or a (poly)alkoxylate of the polybutyl or polyisobutyl alcohol of the formula I or a corresponding carboxylate of the polybutyl or polyisobutyl alcohol.

In a preferred embodiment, the (poly)alkoxylate of the polybutyl or polyisobutyl alcohol is one of the general formula (II)

$$R—CH_2-[O—(CH_2)_n]_m OH \qquad (II)$$

where R has the above meanings, n is an integer from 2 to 8 and m is an integer from 1 to 200.

Particularly preferred (poly)alkoxylates of polybutyl or polyisobutyl alcohols are those derived from ethylene oxide, propylene oxide or butylene oxide or a mixture of these. In this context, it may be stated that the term (poly)alkoxylate is intended to include alkoxylates and polyalkoxylates of polybutyl or polyisobutyl alcohol. In the general formula (II), this is expressed by the index m, which in the case of alkoxylates is 1 and in the case of (poly)alkoxylates is $>1$.

In the above general formula (II), the index n is from 2 to 8, preferably from 2 to 4 and the index m is an integer from 1 to 200, preferably from 5 to 100, particularly preferably from 10 to 50.

It is of course also possible to use mixtures of the (poly)alkoxylates. These result, for example, from the use of mixtures of ethylene oxide, propylene oxide and butylene oxide. Ethylene oxide and propylene oxide are particularly preferred starting components.

Where the novel motor fuel composition or lubricant composition contains an appropriate ester of a polybutyl or polyisobutyl alcohol of the general formula (I), the ester-forming acid group may be one which is derived from saturated and unsaturated, aliphatic or aromatic, acyclic or cyclic mono- or polycarboxylic acids. The monocarboxylic acid radical is preferably of 2 to 9 carbon atoms. The acid radical may also be derived from hydroxycarboxylic acids, for example from citric acid. The di-, tri- and tetracarboxylic acids from which the acid group is derived may likewise be saturated and unsaturated, aliphatic or aromatic, acyclic or cyclic carboxylic acids, in particular those of 4 to 9 carbon atoms. The carboxylic acid groups can, if necessary, also contain basic functions. These basic functions are produced by reacting the acid group in the ester with, for example, $NH_3$ or mono-, di-, tri-, tetra- or polyamines or -amides. This gives the corresponding ammonium or amine salts, amides or imides or mixtures of these. Such esters provided with basic functions are particularly preferred.

Typical examples of carboxylic acids are acetic acid, propionic acid, ethylhexanoic acid, isononanoic acid, succinic acid, adipic acid, maleic acid, phthalic acid, terephthalic acid, trimellitic acid, trimesic acid, pyromellitic acid and butanetetracarboxylic acid.

The novel motor fuel compositions and lubricant compositions may also contain combinations of the polybutyl or polyisobutyl alcohol of the general formula (I) with the corresponding (poly)alkoxylates or esters of the polybutyl or polyisobutyl alcohols.

The present invention also relates to the novel esters and (poly)alkoxylates of the polybutyl or polyisobutyl alcohol of the general formula (VII)

$$R—CH_2—O—R' \qquad (VII)$$

where R has the above meanings and R′ is an acyl radical or, together with the oxygen, forms a (poly)alkoxylate radical. The acyl radical R′ is, in particular, one which is derived from a saturated or unsaturated, aliphatic or aromatic, acyclic or cyclic mono- or polycarboxylic acid having, in particular, the above possible meanings. The (poly)alkoxylate group —O—R′ may, in particular, be of the formula $$\left[O-(CH_2)_n\right]_m OH$$

where n and m have the meanings stated at the outset.

In a particularly preferred embodiment, the novel motor fuel compositions or lubricant compositions contain, in addition to the polybutyl or polyisobutyl alcohol of the general formula (I) or its (poly)alkoxylates or esters, nitrogen-containing additives. These may be conventional nitrogen-containing additives or those of the general formula (III)

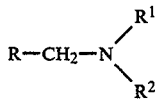

(III)

where R is as defined above and $R^1$ and $R^2$ may be identical or different and are each hydrogen, an aliphatic or aromatic hydrocarbon radical, a primary or secondary, aromatic or aliphatic aminoalkylene radical or a polyaminoalkylene, polyoxyalkylene, hetaryl or heterocyclyl radical, or, together with the nitrogen to which they are bonded, form a ring which may contain further hetero atoms.

In a particularly preferred embodiment, in the general formula (III), $R^1$ and $R^2$ are identical or different and are each hydrogen, alkyl, aryl, hydroxyalkyl, an aminoalkylene radical of the general formula (IV)

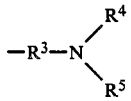

(IV)

where $R^3$ is alkylene and $R^4$ and $R^5$ are identical or different and are each hydrogen, alkyl, aryl, hydroxyalkyl or polybutyl or polyisobutyl, a polyaminoalkylene radical of the general formula (V)

$$\left[R^s-NR^4\right]_m R^5 \qquad (V)$$

where the radicals $R^3$ are each identical or different and the radicals $R^4$ are each identical or different, and $R^3$, $R^4$ and $R^5$ have the above meanings, and m is an integer from 2 to 8, or a polyoxyalkylene radical of the general formula (VI)

$$\left[R^3-O\right]_n X \qquad (VI)$$

where the radicals $R^3$ may be identical or different and have the above meanings, X is alkyl or H, and n is an integer from 1 to 30, or $R^1$ and $R^2$, together with the nitrogen atom to which they are bonded, form a morpholinyl, pyridyl, piperidyl, pyrrolyl, pyrimidinyl, pyrrolinyl, pyrrolidinyl, pyrazinyl or pyridazinyl radical.

The present invention also relates to the use of polybutyl or polyisobutyl alcohols of the general formula (I)

$$R-CH_2-OH \qquad (I)$$

where R is a polybutyl or polyisobutyl radical derived from isobutene and up to 20% by weight of n-butene, or the corresponding (poly)alkoxylates or esters of the polybutyl or polyisobutyl alcohols in motor fuel compositions or lubricant compositions.

The polybutyl or polyisobutyl alcohols to be used according to the invention and their (poly)alkoxylates or esters have excellent compatibility with detergents. They can be obtained in an extremely economical manner by hydroformylation of polybutenes and hydrogenation of the oxo product. In contrast to the prior art, this gives virtually halogen-free products (i.e. products which are free of chlorine or bromine). The relatively economical functionalization of polybutene by hydroformylation opens up, via polybutyl alcohol, a large number of possible reactions with formation of useful carriers which, particularly in the case of the (poly)alkoxylates and esters, also have a detergent action.

The compounds in the novel motor fuel compositions or lubricant compositions are prepared from polybutenes which preferably have a molecular weight $\overline{M}_N$ of from 324 to 3,000, particularly advantageously from 378 to 1,500. The reactivity, i.e. the $\alpha$- and $\beta$-olefin content of the polybutene, should be as high as possible. Such polybutenes are obtained in general by polymerization of isobutene and isobutene-containing olefin cuts in the presence of $BF_3$ and aluminum halides or aluminumalkyls. Small amounts of catalyst and short reaction times, as described in DE-A-27 02 604, are preferred.

The hydroformylation can be carried out using a conventional rhodium or cobalt catalyst at from 80° to 200° C., preferably from 120° to 190° C. and under a $CO/H_2$ pressure of up to 600, preferably from 50 to 300, bar. A two-stage reaction is preferred, the first stage being effected at low temperatures, e.g. 120° C., and the second stage at high temperatures, e.g. 180° C. In the first stage, the reactive double bonds are predominantly converted to aldehydes and ketones, while the hydrogenation appears as a competing reaction only in the second stage. When the reaction time is sufficiently long, this procedure gives a completely hydrogenated product having a high content of polyisobutyl alcohol (70–90%). In carrying out the reaction, it is advantageous to use an inert solvent which can absorb hydrogen only to a limited extent and causes virtually no poisoning of the hydroformylation catalyst. Examples of suitable solvents are $C_8$–$C_{16}$-isoparaffins. The solvent should reduce the viscosity of the polyisobutene. It can be distilled off after the oxo reaction and the hydrogenation, or not until further reactions such as alkoxylation or esterification have been carried out, or, in the case of the ashless dispersants, can be replaced with mineral oil, for example Solvent Neutral 100.

The addition reaction of alkylene oxides with alcoholates in the presence of a basic catalyst is sufficiently well known. Ethylene oxide, propylene oxide and butylene oxide and mixtures of these are particularly important industrially, but addition reactions of compounds such as cyclohexene oxide are also possible. A particular advantage of this class of compound is the good compatibility with motor fuel and mineral oil, owing to the long, nonpolar polyisobutyl radical. The compatibility with mineral oil is of particular interest and is achieved only to a limited extent in the case of low molecular weight alcohols with butylene oxide.

Here, the expensive butylene oxide can be replaced with cheaper oxides. The amount of oxide added preferably depends on the compatibility with the mineral oil, but should not exceed the molecular weight of the polyisobutene. Another advantage of this method of modification with polyisobutene is the reduction in the viscosity and hence, for example, less tendency to valve sticking when used as a fuel additive.

The esterification of polyisobutyl alcohol or polyisobutyl alkoxylates is also carried out by conventional methods. The end of the reaction is indicated by a decreasing OH number. In addition to mono- and dicarboxylic acids, however, tri- and tetracarboxylic acids are of particular interest. In choosing the acid, the viscosity resulting from the use of an appropriate polyisobutyl alcohol is generally taken into account. Mono- and dicarboxylic acids permit the use of higher polyisobutyl alcohols or alkoxylates than tri- and tetracarboxylic acids. The acids can also be used in the form of their esters or anhydrides for the synthesis.

For the synthesis of ashless dispersants, suitable acids are di-, tri- and tetracarboxylic acids, which must be only partially esterified in order to permit the introduction of further polar groups with the aid of ammonia, an amine or an amide. The amides, imides or ammonium or amine salts obtained, depending on the reaction conditions, possess in some cases outstanding dispersing properties. In a particularly preferred embodiment, phthalic anhydride or trimellitic anhydride is reacted with polyisobutyl alcohol in a molar ratio of 1:1. This process leads to products of high chemical purity. In another reaction stage, the still free carboxylic acid groups are reacted with, for example, polyamines, such as diethylenetriamine, triethylenetetraamine or triethylenepentamine, half a mole of amine being added per free carboxylic acid group. By maintaining a reaction temperature of 180° C. for 6 hours, amide structures are obtained. Mineral oil is preferably used as a solvent for these highly viscous substances.

The polybutyl- or polyisobutylamines of the general formula III which are proposed for combination with, in particular, the polyisobutyl alcohol can be prepared by hydroformylating an appropriate polybutene or polyisobutene using a rhodium or cobalt catalyst in the presence of CO and $H_2$ at from 80° to 200° C. and under a $CO/H_2$ pressure of up to 600 bar and then subjecting the oxo product to a Mannich reaction or amination under hydrogenating conditions. The amination reaction is advantageously carried out at from 0° to 200° C. and under a superatmospheric pressure of up to 600, preferably from 80 to 300, bar.

The preparation process is advantageously carried out using a suitable inert solvent in order to reduce the viscosity of the reaction mixture. Particularly suitable solvents are low-sulfur aliphatic, cycloaliphatic and aromatic hydrocarbons. Aliphatic solvents which are free of sulfur compounds and contain less than 1% of aromatics are particularly preferred.

The polybutenes which are used in the process for the preparation of the polybutyl- or polyisobutylamines and are composed predominantly of isobutene units (the isobutene content is generally higher than 80% by weight) have, for example, a molecular weight $\overline{M}_N$ of from 300 to 5,000, preferably from 500 to 2,500. Reactive polybutenes, in particular polybutene A, B or C, can be used. A reactive polybutene is an unsaturated polymer of high chemical purity, more than 10% of the double bonds being in the α-position. A method for the preparation of such polybutenes is described in DE-A-27 02 604. A polymer prepared in this manner contains about 60% of α-olefin and 30% of trisubstituted β-olefin.

Moderately reactive polybutenes are generally obtained by polymerization of isobutene or isobutene-containing $C_4$ cuts using an aluminum-containing catalyst, are chemically less pure and contain only small amounts of α-olefin, generally less than 10%. The signals in the $^{13}C$-NMR show the difference. The amount of trisubstituted, chemically pure β-olefin in polybutene B is about 40%, and that of the α-olefin is about 10%.

Finally, polybutene A must be regarded as having little reactivity and contains no significant chemically pure units.

Particularly suitable polybutenes and polyisobutenes for the preparation of the novel polyamines of the general formula I and of the novel alcohols of the general formula V are those which have a mean degree of polymerization P of from 10 to 100 and in which the proportion E of double bonds capable of reacting with maleic anhydride is from 60 to 90%. Here, a value E of 100% corresponds to the calculated theoretical value for the case in which each molecule of the butene or isobutene polymer contains such a reactive double bond. E is calculated for a reaction of the polyisobutene with maleic anhydride in a weight ratio of 5:1, the stirred mixture being heated at 200° C. for 4 hours. Further details in this context are described in GB-A-1 592 016, the disclosure of which is hereby incorporated by reference.

The polybutenes are commercial products.

The oxo product formed in the hydroformylation is usually obtained as an aldehyde/alcohol mixture. It can be further processed as a mixture or can be completely hydrogenated beforehand to improve its shelf life. Completely hydrogenated products are less reactive.

For economic reasons, polybutyl- or polyisobutylamines of the general formula III, where $R^2$ and $R^3$ are each hydrogen, are suitable for the fuel sector, i.e. in the novel fuel compositions, particularly as additives for cleaning valves or keeping them clean, in combination with the polyisobutyl alcohol and its derivatives.

The compounds to be used according to the invention are added to the motor fuels or lubricants in small amounts, in general in amounts of from 0.005 to 0.5, preferably from 0.01 to 0.1, % by weight, based on the motor fuels or lubricants.

The Examples which follow illustrate the invention.

EXAMPLE 1

Example of lubricant additive 140 g of polyisobutyl alcohol having a number average molecular weight $\overline{M}_N$ of 980 are reacted with 19.2 g of trimellitic anhydride in 100 g of the mineral oil Solvent Neutral 100. The mixture is stirred at 150° C. until a clear solution has formed, but stirring is continued for not less than 1 hour. Thereafter, 21 g of diethylenetriamine are added at 90° C., stirring is continued for a further hour and the pressure is slowly decreased to 1 mbar. The temperature is then increased to 200° C. and stirring is carried out for 3 hours. After cooling, the dispersant is tested by the spot test as described by A. Schilling in Les Huiles pour Moteurs et le Graissage de Moteurs, Vol. 1, 1962, pages 89–90.

The rating is 714 and is thus in the region of that of good Mannich dispersants or those based on polyisobutenylsuccinic anhydride.

EXAMPLE 2

Novel combination formulations of motor fuel additives

The following experiments are carried out in a 1.2 l Opel Kadett engine according to CEC method F-02-C-79, using a premium grade motor fuel of research octane no. 98, and the valve deposits are determined gravimetrically

TABLE

| No. | Additive [mg/kg] | Type | Intake valve deposition Mean value in mg/valve |
|---|---|---|---|
| 1 | — | — | 300 |
| 2 | 300 | polybutylamine | 0 |
| 3 | 150 | polybutylamine | 210 |
| 4 | 150 | polybutylamine | |
| | 150 | polybutyl alcohol | 10 |
| 5 | 150 | polybutylamine | |
| | 150 | polybutyl alcohol . 10 PO | 15 |
| 6 | 150 | polybutylamine | |
| | 150 | polyisobutyl adipate | 0 |

The Table shows that the combination of polybutyl alcohol and polybutylamine leads to excellent valve deposition values.

The preparation of the polybutyamine is described below:

500 g of polybutene having a molecular weight $\overline{M}_N$ of 950, 300 g of dodecane and 2.8 g of cobalt octacarbonyl are heated in a 2.5 l autoclave equipped with a lift-type stirrer under a 1:1 $CO/H_2$ pressure of 280 bar, while stirring, for 5 hours at 185° C. Thereafter, the mixture is cooled to room temperature and the catalyst is removed using 400 ml of 10% strength aqueous acetic acid. The mixture is then washed neutral. The resulting oxo product is treated with 1 l of ammonia as well as 300 g of ethanol and 100 g of Raney cobalt in a 5 l rotating autoclave under a hydrogen pressure of 200 bar at 180° C. for 5 hours. After the mixture has cooled, the catalyst is separated off by filtration, the excess ammonia is evaporated and the solvent is removed by distillation.

The polybutene used in this Example is a highly reactive polybutene C, which was prepared as described in DE-A 2 702 604.

We claim:

1. A motor fuel composition which contains 0.005 to 0.5% by weight of one or more polybutyl or polyisobutyl alcohols of the formula (I)

$$R-CH_2-OH \quad (I)$$

where R is a polybutyl or polyisobutyl radical derived from isobutene and up to 20% by weight of n-butene and having a molecular weight $\overline{M}_N$ of from 324 to 3,000, or a corresponding (poly)alkoxylate or a corresponding carboxylate of the polybutyl or polyisobutyl alcohol, wherein said polybutyl or polyisobutyl alcohol is prepared by hydroformylating the corresponding polybutene or polyisobutene using a rhodium or cobalt catalyst at from 80° to 200° C. under a $CO/H_2$ pressure of up to 600 bar.

2. The motor fuel composition of claim 1, wherein the (poly)alkoxylate of the polybutyl or polyisobutyl alcohol is one of the formula (II)

$$R-CH_2-[O-(CH_2)_n]_m-OH \quad (II)$$

where R has the meanings stated in claim 1, n is an integer from 2 to 8 and m is an integer from 1 to 200.

3. The motor fuel composition of claim 1, wherein, in the ester of the polybutyl or polyisobutyl alcohol, the acid component is derived from a saturated or unsaturated, aliphatic or aromatic mono-, di-, tri- or tetracarboxylic acid.

4. The motor fuel composition of claim 2, wherein the (poly)alkoxylate of the polybutyl or polyisobutyl alcohol is prepared by reaction with ethylene oxide, propylene oxide or butylene oxide or a mixture of these.

5. The motor fuel composition of claim 3, wherein the acid component of the ester of the polybutyl or polyisobutyl alcohol is derived from di-, tri- and tetracarboxylic acids which have been reacted with ammonia, mono-, di-, tri-, tetra- or polyamines to give the corresponding ammonium or amine salts, amides or imides or a mixture of these.

6. The motor fuel composition of claim 3, wherein the acid component of the ester of the polybutyl or polyisobutyl alcohol is derived from acetic acid, propionic acid, ethylhexanoic acid, isononanoic acid, succinic acid, adipic acid, maleic acid, phthalic acid, terephthalic acid, citric acid, trimellitic acid, trimesic acid, pyromellitic acid or butanetetracarboxylic acid.

7. The motor fuel composition of claim 1, additionally containing 0.005 to 0.5% by weight of nitrogen-containing additives.

8. The motor fuel composition of claim 1, additionally containing 0.005 to 0.5% by weight of one or ore polybutyl- or polyisobutylamines of the formula (III)

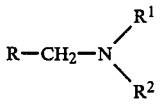

(III)

where R is as defined in claim 1 and $R^1$ and $R^2$ may be identical or different and are each hydrogen, an aliphatic or aromatic hydrocarbon radical, a primary or secondary, aromatic or aliphatic aminoalkylene radical or a polyaminoalkylene, polyalkoxyalkylene, hetaryl or heterocyclyl radical, or together with the nitrogen atom to which they are bonded, form a ring which may contain further hetero atoms.

9. The motor fuel composition of claim 8, wherein, the formula III, $R^1$ and $R^2$ are identical or difference and are each hydrogen, alkyl, aryl, hydroxylalkyl, an aminoalkylene radical of the formula (IV)

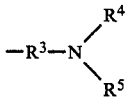

(IV)

where $R^3$ is alkylene and $R^4$ and $R^5$ are identical or different and are each hydrogen, alkyl, aryl, hydroxyalkyl or polybutyl or polyisobutyl, a polyaminoalkylene radical of the formula (V)

$$-[R^3-NR^4]_m-R^5 \quad (V)$$

where the radicals $R^3$ are each identical or different and the radicals $R^4$ are each identical or different, and $R^3$, $R^4$ and $R^5$ have the above meanings, and m is an integer from 2 to 8, or a polyoxyalkylene radical of the formula (VI)

$$-[R^3-O]_n X \quad (VI)$$

where the radicals $R^3$ may be identical or different and have the above meanings, X is alkyl or H and n is an integer of from 1 to 30, or $R^1$ and $R^2$, together with the nitrogen atom to which they are bonded, form a morpholinyl, pyridyl, piperidyl, pyrrolyl, pyrimidinyl, pyrrolinyl, pyrrolidinyl, pyrazinyl, or pyridazinyl radical.

* * * * *

UNITED STATES PATENT AND TRADEMARK OFFICE

CERTIFICATE OF CORRECTION

PATENT NO. : 4,859,210

DATED : August 22, 1989

INVENTOR(S) : Dieter Franz et al.

It is certified that error appears in the above-identified patent and that said Letters Patent is hereby corrected as shown below:

On the title page, insert

--[30] Froreign Application Priority Data

January 8, 1987 Federal Republic of Germany 3700363--.

Signed and Sealed this

Twelfth Day of June, 1990

*Attest:*

HARRY F. MANBECK, JR.

*Attesting Officer*

*Commissioner of Patents and Trademarks*